United States Patent [19]

Fall

[11] 4,089,568

[45] May 16, 1978

[54] SLIDE ASSEMBLY WITH BEARING RETAINERS COUPLED BY FLOATING CLIP

[75] Inventor: Martin K. Fall, Indianapolis, Ind.

[73] Assignee: Herbert S. Fall, Indianapolis, Ind.

[21] Appl. No.: 788,677

[22] Filed: Apr. 18, 1977

[51] Int. Cl.[2] ..... F16C 21/00; F16C 29/04

[52] U.S. Cl. ..... 308/3.8; 308/6 R; 312/348

[58] Field of Search ..... 308/3.6, 3.8, 6 R, 189, 308/195, 199, 201; 312/334, 341, 348, 332, 340; 108/143

[56] References Cited

U.S. PATENT DOCUMENTS

| | | | |
|---|---|---|---|
| 3,205,025 | 9/1965 | Jordan | 308/3.8 |
| 3,488,097 | 1/1970 | Fall | 308/3.8 |

FOREIGN PATENT DOCUMENTS

| | | | |
|---|---|---|---|
| 122,359 | 10/1946 | Australia | 308/3.8 |

*Primary Examiner*—Trygve M. Blix

*Assistant Examiner*—Douglas C. Butler

*Attorney, Agent, or Firm*—Jenkins, Coffey & Hyland

[57] ABSTRACT

A slide assembly includes an improved bearing assembly. The slide assembly includes first and second track members providing two transversely spaced, longitudinally extending parallel bearing races. A stop may be formed in at least one of the track members to project into one of the races. The improved bearing assembly includes first and second sets of bearings for insertion into the first and second races, respectively. The bearings of the first set are separated from one another by a first bearing retainer, and the bearings of the second set are separated from one another by a second retainer. A plate constructed from a substantially thinner material than either of the bearing retainers extends therebetween and connects the first and second retainers for movement together. The plate is loosely connected to the retainers to permit some floating movement of the plate.

14 Claims, 4 Drawing Figures

SLIDE ASSEMBLY WITH BEARING RETAINERS COUPLED BY FLOATING CLIP

The present invention relates to bearing slides for movably supporting a structure between a retracted position and an extended position. More particularly, the present invention deals with an improved bearing assembly including a bearing retainer for each of two or more sets of bearings and means for connecting the various sets of bearing for movement together.

Ball bearing drawer slide mechanisms utilizing bearing retainers are well known. Examples of such drawer slides are illustrated in the following United States Patents Nos: 2,606,090 issued Aug. 5, 1952; 3,205,025 issued Sept. 7, 1965; 3,389,949 issued June 25, 1968; 3,488,097 issued Jan. 6, 1970; 3,679,275 issued July 25, 1972; 3,687,505 issued August 29, 1972; 3,738,716 issued June 12, 1973; and 3,801,166 issued April 2, 1974. The bearing retainers of the devices illustrated in the aforementioned patents extend substantially all the way across the track members between which they are positioned. The retainers move relative to the track members.

According to the invention, a slide includes a first track member providing two transversely spaced, longitudinally parallel facing grooves with a connecting portion therebetween, a second track member providing two transversely spaced, longitudinally parallel oppositely directed grooves with a connecting portion therebetween. The grooves of the second track member cooperate with respective grooves of the first track member to define first and second bearing races. The improved bearing assembly comprises first and second sets of bearings for insertion into the first and second races, respectively. The bearings of the first set are separated from one another by a first bearing retainer, and the bearings of the second set are separated by a second bearing retainer. The improvement further comprises means for connecting the first and second retainers to move the first and second pluralities of bearings together. The connecting means extends transversely of the track members between the connecting portions thereof. The bearing retainers desirably are constructed from a first material having a thickness sufficient to retain the bearings while the engaging means is constructed from substantially thinner material.

In one embodiment, the engaging means is a thin clip or plate having at least one engaging projection or ear formed on each of its longitudinal sides. The engaging ears on one longitudinal side project into openings provided in the first bearing retainer. The engaging ears on the other longitudinal side project into the openings provided in the second retainer. Desirably, the ears are loosely received in the retainers for limited free "floating" movement transversely of the direction of motion of the bearing assembly. The invention may best be understood by referring to the following description and accompanying drawings which illustrate the invention. In the drawings:

Figure 3:
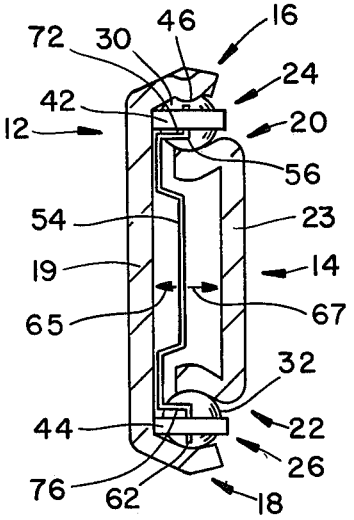
Figure 1:
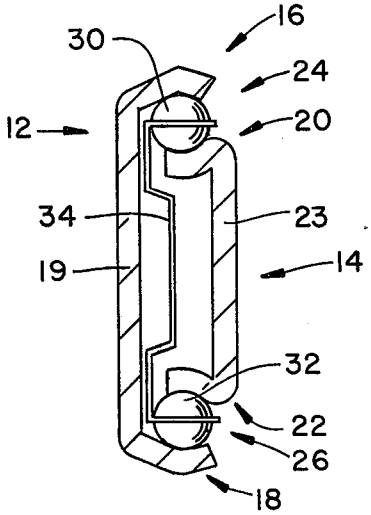
Fig. 1 Prior Art
FIG. 1 is a transverse sectional view of a prior art slide assembly.
Figure 4:
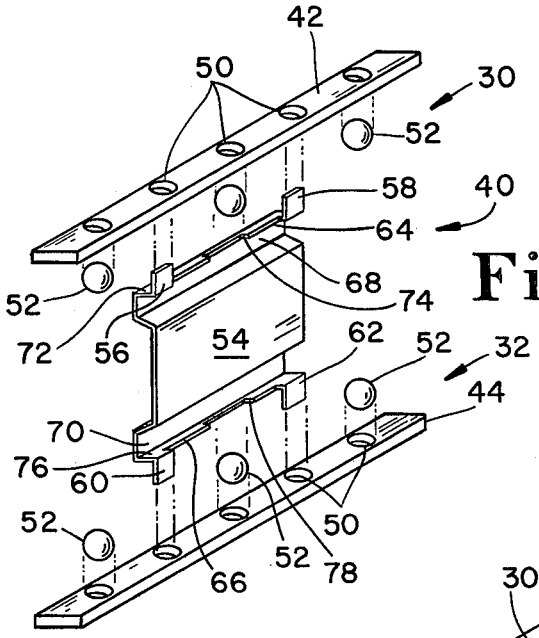
Figure 2:
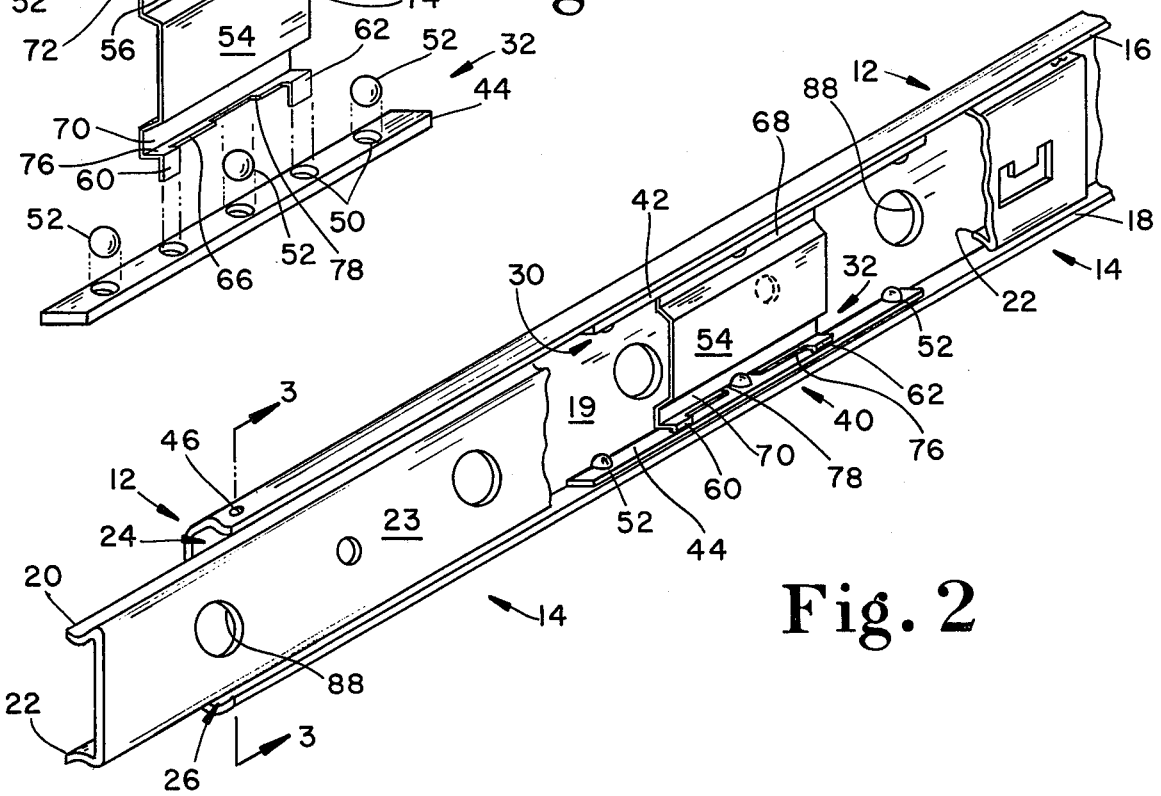
FIG. 2 is a perspective view of the slide assembly of the present invention.

FIG. 3 is a transverse sectional view taken along section lines 3—3 of FIG. 2; and FIG. 4 is an exploded perspective view of the bearing assembly of FIGS. 2—3. In FIG. 1, a prior art slide assembly 10 of the type disclosed in the aforementioned United States patents is shown. Such an assembly 10 includes first and second longitudinally extending track members 12, 14, respectively. Track member 12 includes an upper longitudinally curled lip providing a groove 16 and a lower longitudinally curled lip providing a groove 18 connected by a generally planar connecting portion 19. Track member 14 includes a longitudinally curled lip providing a groove 20 which faces groove 16, and a longitudinally curled lip providing a groove 22 which faces groove 18. Grooves 20, 22 are connected by a generally planar connecting portion 23 which extends longitudinally parallel to, and is spaced apart transversely from, connecting portion 19. A race 24 is defined by grooves 16, 20. A race 26 is defined by grooves 18, 22. A first set of bearings 30 is provided in race 24. A second set of bearings 32 is provided in race 26. In the prior art, the two sets of bearings 30, 32 are coupled to move together in races 24, 26 by a retainer 34. Retainer 34 also maintains the spacings between individual bearings of sets 30, 32. The retainer extends generally between the parallel connecting portions 19, 23 to engage the bearings of sets 30, 32.

In the improved slide assembly of FIGS. 2-4, those elements which are numbered identically with the elements illustrated in FIG. 1 perform the same or similar functions. In the improved slide assembly a bearing assembly 40 provided between track members 12, 14 comprises a first, or upper, retainer 42 and a second, or lower, retainer 44. Retainers 42, 44 are both longitudinally extending, transversely narrow strips which are quite thick and rugged. In the illustrated embodiment, each retainer 42, 44 includes five longitudinally equally spaced holes 50. Three ball bearings 52 form each of the upper and lower sets 30, 32, respectively. A stop 46 projects from the floor of groove 16 sufficiently so that one of the bearings of set 30 will run against it to stop motion of the bearing assembly with respect to track 12. Stop 46 is formed by dimpling groove 16 from the outside as illustrated. The retainers 42, 44 are constructed from a relatively thick material to avoid damage thereto by engagement of one of bearings 52 with stop 46.

Retainers 42, 44 are connected for movement together by a connecting plate or clip 54 which is made of thinner material than retainers 42, 44. Connecting plate 54 illustratively is generally rectangular and has four engaging projections or ears 52, 58, 60, 62 formed at its four corners. Engaging projections 56, 58 are formed along the upper longitudinal edge 64 of plate 54 and are received in the two vacant holes 50 of retainer 42. Ears 60, 62 are formed along the lower longitudinal edge 66 of plate 54 and are received in the two vacant holes 50 of retainer 44. Ears 56, 58, 60, 62 are loosely received in holes 50 so that the plate 54 has limited "floating" movement transversely of tracks 12, 14 as indicated by arrows 65, 67 in FIG. 3. This floating movement allows the plate 54 to move past obstructions, such as the heads of track mounting screws, etc., which occupy space between the tracks 12, 14.

A longitudinally extending channel 68 is provided in plate 54 adjacent upper edge 64. A similar channel 70 is provided adjacent lower longitudinal edge 66. These channels 68, 70 allow track 14 to nest within track 12. The upper side wall 72 of groove 68 includes a clearance notch 74 (FIG. 4) to avoid interference between edge 64 of plate 54 and the middle bearing 52 in retainer 42. The lower side wall 76 of lower longitudinally edge 66 also includes a clearance notch 78 (FIGS. 2, 4) to avoid interference between lower longitudinal edge 66 of plate 54 and the middle bearing 52 of retainer 44.

In the illustrated embodiment, the thickness of the material from which plate 54 is fabricated is 0.012 inch. The retainers 42, 44 are fabricated from 0.062 inch sheet metal. The longitudinal centers of the races 24, 26 are spaced apart approximately one inch. The transverse dimension of the slide assembly is approximately five-sixteenth inch. Track members 12, 14 are fabricated from 0.062 inch sheet metal. Bearings 52 are approximately three-eighths inch in diameter.

Other shapes for plate 54, ears 56 and retainers 42, 44 may be utilized while retaining the advantages herein described. The number bearings 52 and the lengths of retainers 42, 44 and plate 54 can vary according to the requirements of a particular application. The provision of a connecting plate separate from the bearing retainers allows the plate to be kept longitudinally quite short while the retainers themselves can be made as long as necessary for a particular application. The longitudinal shortness of the plate has attendant advantages. Access holes 88 are provided through connecting portions 19, 23 of tracks 12, 14 so that the tracks can be mounted on, for example, equipment and equipment cabinets, so that the equipment can be moved between positions within and without the cabinet. The use of longitudinally short plates 54 provides better access through such holes 88 to mounting screws, etc., therein.

What is claimed is:

1. A slide comprising a first elongated track member formed to provide a downwadly facing longitudinal raceway and an upwardly facing longitudinal raceway, a second elongated track member formed to provide an upwardly facing longitudinal raceway in mating registry with the first said downwardly facing raceway and a downwardly facing longitudinal raceway in mating registry with the first said upwardly facing raceway, bearings disposed in said mating raceways to support said track members for relative longitudinal movement, bearing retainer means for maintaining the longitudinal spacing between said bearings in said raceways, said retainer means being longitudinally movable relative to said track members, said retainer means including a longitudinally extending rigid retainer bar between each set of mating raceway, and means for connecting said bars for movement together, said connecting means including a clip extending between and loosely connected to said bars to move transversely a limited amount relative to said track members.

2. The invention of claim 1 in which said bearings are ball bearings and each of said bars is provided with longitudinally spaced apertures for said ball bearings, said clip having tabs extending into said apertures to connect said bars and clip.

3. The invention of claim 1 wherein a stop is formed in at least one of said raceways to project thereinto and engage one of said bearings to limit movement of said bearings relative to said stop.

4. In a drawer slide comprising a first elongated track member formed to provide a longitudinally and outwardly extending first downwardly facing raceway along its upper edge and a longitudinally and outwardly extending first upwardly facing raceway along its lower edge, a second track member formed to provide a longitudinally and inwardly extending second upwardly facing raceway along its upper edge and a longitudinally and inwardly extending second downwardly facing raceway along its lower edge, ball bearings carried on said first upwardly facing raceway and under and in rolling contact with said second downwardly facing raceway and additional ball bearings carried on said second upwardly facing raceway and under and in rolling contact with said first downwardly facing raceway, the improvement comprising first and second rigid stiff spacer bars for said ball bearings and said additional ball bearings, respectively, and a plate for connecting said bars for longitudinal movement together, said plate being loosely connected to said bars to provide for slight transverse shifting of said plate relative to said track members.

5. In a slide assembly comprising a first track member having two longitudinal edges providing two transversely spaced, longitudinally parallel facing grooves with a connecting portion therebetween, a second track member having two longitudinal edges providing two transversely spaced, longitudinally parallel oppositely directed grooves with a connecting portion therebetween, the grooves of the second track member being arranged in facing registry with the respective grooves of the first track member, a first bearing race being defined between a first parallel pair of grooves of the first and second track members, a second bearing race being defined between a second pair of grooves of the first and second track members, a bearing assembly comprising a first plurality of bearings for insertion into the first race, a second plurality of bearings for insertion into the second race, a first bearing retainer for separating the bearings of the first plurality, a second bearing retainer for separating the bearings of the second plurality, and means for connecting the first and second retainers to move the first and second pluralities of bearings together, the connecting means including a clip loosely connected to said retainers to move transversely a limited amount relative to said track members.

6. The assembly of claim 5 wherein the clip is formed from a relatively thinner material than the bearing retainers, the clip having two longitudinal edges, each edge being provided with at least one projection to engage a respective one of the bearing retainers.

7. The assembly of claim 6 wherein each bearing retainer comprises a longitudinally extending strip of material provided with a plurality of generally circular holes, the projections on the clip engaging holes of a respective one of the bearing retainers.

8. The assembly of claim 6 wherein the clip further includes a longitudinally extending channel adjacent each longitudinal edge thereof, the channels receiving respective longitudinal edges of the second track member to provide nesting of the second track member substantially between the longitudinal edges of the first track member.

9. The assembly of claim 5 wherein the clip loosely engages the first and second retainers for limited transverse floating movement with respect to the first and second track members to ride over obstructions lying between the connecting portions of the track members.

10. The assembly of claim 5 wherein the clip is longitudinally short relative to the first and second bearing retainers.

11. The assembly of claim 5 wherein a stop for limiting motion of the bearings with respect to one of the track members is formed to project into one of the races.

12. A slide comprising first and second tracks each having first and second grooves, the first grooves of the first and second tracks facing each other to define a first race and the second grooves of the first and second tracks facing each other to define a second race, and a bearing assembly comprising a first plurality of bearings for insertion into the first race, a second plurality of bearings for insertion into the second race, a first retainer for spacing the bearings of the first plurality, a second retainer for spacing the bearings of the second plurality, and a clip for connecting the first and second retainers to move the first and second pluralities of bearings in synchronism, the clip extending between the first and second races, the clip being loosely connected to the first and second retainers to move transversely a limited amount relative to the first and second races.

13. The slide of claim 12 wherein a stop for limiting motion of the bearing assembly with respect to one of the tracks is formed to project into one of the races.

14. The slide of claim 13 wherein the first and second bearing retainers are constructed from a material having a first thickness and the clip is constructed from a substantially thinner material.

* * * * *